United States Patent [19]

Kotian et al.

[11] Patent Number: 4,520,260

[45] Date of Patent: May 28, 1985

[54] SEMI-CONDUCTIVE HEATING CABLE

[75] Inventors: Vijayraj M. Kotian, Stow; Roger L. Blumer, Cortland; William J. Herbert, Mantua, all of Ohio

[73] Assignee: Eaton Corporation, Cleveland, Ohio

[21] Appl. No.: 548,189

[22] Filed: Nov. 2, 1983

[51] Int. Cl.[3] ..... H05B 3/10

[52] U.S. Cl. ..... 219/553; 219/528; 338/22 R; 204/159.2

[58] Field of Search ..... 204/159.2; 219/528, 219/549, 553; 338/22 R, 22 SD

[56] References Cited

U.S. PATENT DOCUMENTS

| | | | |
|---|---|---|---|
| 3,769,370 | 10/1973 | Martin et al. | 525/199 |
| 4,052,279 | 10/1977 | Lyons | 204/159.2 |
| 4,200,973 | 5/1980 | Farkas | 219/549 |
| 4,226,687 | 10/1980 | Sasaki et al. | 204/159.2 |
| 4,264,490 | 4/1981 | Beiejka | 204/159.2 |

*Primary Examiner*—Jacob Ziegler

*Attorney, Agent, or Firm*—C. H. Grace; A. E. Chrow

[57] ABSTRACT

Disclosed is an improved semi-conductive heating cable having semi-conductive material surrounded by a jacket that is imparted with improved resistance to color change upon exposure to elevated temperatures and is able to minimize changes in the ambient electrical resistivity of the semi-conductive composition arising from exposure of the cable to elevated temperatures by reason of the jacket being made from a radiation cross-linked composition comprising a mixture of at least one elastomer with at least one polyolefin and at least one heat stabilizer wherein the preferred elastomer comprises either or both a terpolymer of ethylene, propylene and at least one diene or an ethylene propylene rubber and the polyolefin is a polypropylene polymer.

34 Claims, No Drawings

SEMI-CONDUCTIVE HEATING CABLE

INTRODUCTION

This invention relates generally to a flexible, electrically semi-conductive, self-regulating heating cable of the type having at least one pair of spaced-apart elongate electrical conductors electrically interconnected by a semi-conductive composition that is enclosed by at least one protective jacket and more particularly to a means for improving the ambient electrical resistance stability of the semi-conductive composition in addition to improving color stability and resistance to radiation and elevated temperature degradation of the jacket by preparing the jacket from certain elastomeric compositions.

BACKGROUND OF THE INVENTION

Self-regulating, electrically semi-conductive, heating cables are well known in the art. They generally feature at least one pair of elongate electrical conductors such as copper wires that are spaced apart from each coextensively along the length of the cable within a semi-conductive composition that typically comprises one or more polymeric materials such as a polyolefin or fluorocarbon or chlorofluorocarbon materials containing uniformly dispersed electrically conductive particles, commonly conductive carbon black particles, enclosed within at least one electrically insulative protective jacket. Examples of self-regulating heating cables of the type described above are disclosed for example in U.S. Pat. Nos. 3,858,144; 4,188,276; 4,200,973; 4,277,673; 4,327,480; 4,334,351 and 4,334,148, the disclosures of which are incorporated herein by reference.

Typically, the semi-conductive composition is a composition that exhibits a positive coefficient of electrical resistance with temperature and possesses sufficient crystallinity to promote the self-regulating characteristics desired. Generally, it is common practice to anneal such cables at a temperature at or above the melting temperature of the crystalline portion of the semi-conductive composition for a period of time sufficient to stabilize the electrical resistance and then crosslink the composition, commonly by radiation, to promote the self-regulating characteristics of the composition.

In order to maintain a precise distance between the electrical conductors during the annealing step, it has been the practice to enclose the conductors and semi-conductive compositions with an electrically insulating shape-retaining jacket that is made from a material that has a softening temperature that is higher than the temperature at which the semi-conductive composition is to be annealed. Such cables also typically include one or more polymeric and/or metallic jackets about the shape-retaining jacket for added mechanical protection and the like.

The semi-conductive compositions used in self-regulating heating cables of the type described above typically contain from about 4% to about 25% by weight to the total weight of the composition of one or more electrically conductive carbon black types to promote the self-regulating heating characteristics of the cable. Depending upon the amount of carbon black or other suitable conductive particles present in the semi-conductive composition, such cables will exhibit certain electrical resistance at ambient temperature and a certain profile of increasing electrical resistance for increasing temperatures as is associated with positive temperature coefficient materials as is well known to those ordinarily skilled in the art.

One of the problems in producing such cables is the maintenance of a close tolerance range on ambient electrical resistance of the semi-conductive composition from batch to batch and the stability of the ambient electrical resistance with time and temperature. Although the previously described crosslinking and annealing practice can be used to advantage in controlling the electrical resistance characteristics, it has been discovered that one of the problems contributing to variations in electrical resistance of such semi-conductive compositions is the nature of the jacket used to enclose the semi-conductive composition.

Heretofore, it was thought that any electrically insulative material that was compatible with the semi-conductive composition and possessed a softening temperature higher than the melting temperature of the crystalline portion of the semi-conductive composition in combination with suitable strength characteristics would be suitable. Typically, such jackets in the past have been made from a thermoplastic polyurethane, polyamide or polyester material as described for example in the previously described patents. Polyvinyl chloride materials have also been used for such cables as a means of providing flame retardancy. It has been discovered that self-regulating heating cables that utilize a flexible jacket made from a material containing a plasticizer such as polyvinyl chloride suffer a substantial and undesirable increase in ambient electrical resistance over a period of time and that such will often be the case even when an intermediate jacket made from an unplasticized material is interposed between the semi-conductive composition and the plasticizer-containing jacket and that such is particularly a problem where it is desired to impart flame retardancy to the cable by enclosing the cable with a flame retardant jacket made from a halogenated material such as polyvinyl chloride.

It has also been found that jackets made from conventional materials such as polyurethane or polyester or polyamide suffer marked color change upon exposure to radiation which understandably is a problem in providing jackets of one or more predetermined colors for use in various applications for radiation is commonly used as a method of crosslinking such semi-conductive compositions.

In view of the above, a need exists for providing a protective jacket about self-regulating, electrically semi-conductive heating cables that is able to minimize changes in the ambient electrical resistance of the semi-conductive material arising from exposing the cable to elevated operating temperature conditions and is further able to incorporate halogenated flame retardants without the need for plasticizers when it is desired to impart flame retardancy to the cable and is additionally able to provide improved resistance to color change as well as to degradation arising from exposure to radiation and elevated annealing temperatures associated with the process of making the cable.

SUMMARY OF THE INVENTION

Accordingly, it is an object of this invention to provide a protective jacket for use about a flexible, self-regulating, semi-conductive, heating cable that is able to minimize changes in the ambient electrical resistance of the semi-conductive composition arising from exposure of the cable to elevated temperature.

It is another object of this invention to provide an improved, flexible, self-regulating, semi-conductive heating cable utilizing an electrically semi-conductive composition that is enclosed by a protective jacket that is able to minimize changes in the ambient electrical resistance of the semi-conductive composition arising from exposure of the cable to elevated operating temperatures and additionally provides improved resistance to color changes and degradation upon exposure to radiation and annealing temperatures characteristically associated with the manufacture of such cables.

It is still another object of this invention to provide an improved, flexible, self-regulating, semi-conductive heating cable utilizing a semi-conductive composition that is enclosed by a jacket that can be singularly used as a protective jacket and as a shape-retaining jacket made from a composition that has a softening temperature higher than the temperature at which the cable is to be annealed and is able to minimize changes in ambient electrical resistance of the semi-conductive composition characteristically associated with such cables in addition to providing improved resistance to color change and degradation arising from radiation and annealing temperatures characteristically associated with the manufacture of such cables.

It is still a further object of this invention to provide an improved flexible, self-regulating, electrical heating cable containing a semi-conductive composition that utilizes an encompassing jacket that is made from a composition that provides flame retardancy to the cable as well as minimize changes in ambient electrical resistance characteristically associated with such cables upon their exposure to elevated operating temperature conditions as well as provide improved resistance to color changes and degradation arising from exposure of the cable to radiation and annealing temperatures characteristically associated with the manufacture of such cables.

DESCRIPTION OF THE PREFERRED EMBODIMENT

It has been discovered that a jacket for encompassing a semi-conductive heating cable of the type having at least one pair of elongate spaced-apart electrical conductors electrically interconnected by a semi-conductive composition having a softening temperature higher than the temperature at which the cable is to be annealed and able to minimize changes in ambient electrical resistance characteristically associated with such cables in the past as a result of exposure of the cable to elevated operating temperatures can be made by means of a composition comprising the radiation cross-linked product of a mixture of: (A) from about 50 parts to about 80 parts by weight to the total weight of the composition of certain elastomers which are preferably terpolymers of ethylene, propylene and at least one diene (EPDM) and/or certain ethylene propylene rubbers (EPR); (B) from about 20 parts to about 50 parts by weight to the total weight of the composition of at least one polyolefin polymer and; (C) an effective amount by weight to the total weight of the composition of at least one heat stabilizer.

It has been found that only certain processible elastomeric rubbers may be used. An EPDM rubber found particularly advantageous is sold under the trademark NORDEL 2744 by E.I. DuPont De Nemours.

The polyolefin component (B) of the above described composition is preferably any suitable melt processible polyethylene or polypropylene polymer or blend thereof. Particularly preferred is where the polyolefin is a polypropylene polymer. A polypropylene polymer found particularly useful in making the composition from which the jacket is to be made is sold under the trademark "PROFAX 6823" by Hercules Incorporated.

The heat stabilizer of portion (C) of the above described composition is preferably a lead stabilizer and more preferably a tetra-basic lead fumarate type heat stabilizer such as sold by Associated Lead Incorporated.

The composition comprising a mixture of components (A), (B) and (C) above provides a composition that can be melt extruded as a jacket directly about the semi-conductive composition containing at least two spaced-apart electrical conductors or as an additional jacket about a conventional shape retaining jacket previously disposed about the semi-conductive composition such as polyurethane. The composition is a radiation crosslinkable composition which can be effectively crosslinked upon suitable exposure to radiation preferably high speed electron radiation of about 5 to about 50 megarads. It has been found for example that the preferred ratios of (A), (B) and (C) described below can be effectively crosslinked upon 35 megarad exposure to high energy electrons. It has also been found that an effective amount of a radiation sensitizer in the composition greatly enhances its ability to crosslink.

Although other suitable radiation sensitizers may be used such as N, $N^1$-M-phenylenedimaleimide sold under the trademark "HVA-2" by E.I. DuPont De Nemours, a sensitizer found particularly suitable in making the composition is trimethylolpropane trimethacrylate sold under the trademark "SR-350" by the Sartomer Company. It has been discovered that an effective amount of the radiation sensitizer is from about 1 part to about 5 parts by weight to the total weight of the composition, with a preferred amount being about 2 parts by weight to the total weight of the composition.

Since in most instances it is necessary to crosslink the semi-conductive composition to achieve the electrical resistance and self-regulating characteristics desired, the jacket utilizing the above described ingredients may be crosslinked by radiation at the same time that the semi-conductive composition is crosslinked by radiation.

A composition found particularly suitable for making the improved semi-conductive heating cable of the invention is where above described (A) portion is about 60 parts by weight and the (B) portion is about 40 parts by weight and the (C) portion is about 2 parts by weight and the composition includes about 2 parts by weight of a suitable radiation sensitizer to the total weight of the composition.

The composition for making the improved self-regulating heating cables of the invention may further include one or more colorants and/or halogenated flame retardants and/or antioxidants and/or fillers or other ingredients provided they do not adversely effect the electrical resistance and color stability associated with the basic compositions. A synergistic filler such as antimony oxide is particularly suitable where it is desired to impart flame retardancy to the jacket. Generally, the composition may include from about none to about 20 parts by weight of a filler such as antimony oxide to the total weight of the composition either alone or in conjunction with from about none to about 50 parts by weight of a halogenated flame retardant to the total weight of the composition. A halogenated flame retardant found particularly suitable is decabromobiphenyl oxide sold under the trademark SAYTEX 102E by Saytech Incorporated.

A particularly preferred composition for the jacket is where previously described component (A) is about 60 parts, (B) is about 40 parts; (C) is about 2 parts with the composition further including: about 2 parts of the previously described "SR 350" radiation sensitizer; about 10 parts of antimony oxide; about 35 parts of decabromobiphenyl oxide; about one part of a suitable antioxidant such as the tetra-functional phenolic antioxidant sold by Ciba Geigy under the Trademark "IRGANOX 1010" and; about 2 parts of a suitable colorant by weight to the total weight of the composition.

The composition described immediately above, when blended in a Banbury at about 350° F. and milled at about 375° F. and compression molded into approximate 0.060 inch slabs at about 420° F. for three minutes at about 4,000 psi, exhibited the properties shown in following Table I prior to crosslinking by radiation.

TABLE I

| PROPERTY | METHOD (ASTM) | TYPICAL |
|---|---|---|
| Density (gm/cm$^3$) | D 792 | 1.165 |
| Hardness (Shore A, 10 Sec) | D 2240 | 95 |
| Hardness (Shore D, 10 Sec) | D 2240 | 39 |
| Tensile (psi) | D 638 | 1354 |
| 100% Modulus (psi) | D 638 | 1046 |
| Ultimate elongation (%) | D 638 | 363 |
| Limiting Oxygen index, (%) | D 2863 | 25.1 |

Following Table II shows the ingredients of a preferred jacket composition as example "R" in comparison with other jacket formulations "T", "U" and "V".

TABLE II

| Ingredient | EXAMPLE (Parts of weight to total weight of the composition) R | T | U | V |
|---|---|---|---|---|
| Nordel 2744 | 60 | — | 40 | 60 |
| Profax 6823 | 40 | — | 60 | 40 |
| Santoprene 201-87 | — | 100 | — | — |
| Decabromobiphenyl oxide | 35 | 35 | 35 | — |
| Dechlorane Plus 25 | — | — | — | 20 |
| Tetra-basic lead fumarate | 2 | 2 | 2 | 2 |
| Antimony oxide | 10 | 10 | 10 | 8 |
| Irganox 1010 | 1 | 1 | 1 | 1 |
| SR-350 | 2 | 2 | 2 | 2 |
| Yellow colorant | 2 | 2 | 2 | 2 |

In the above Table II, Dechlorane Plus 25 is a chlorinated flame retardant sold under the Trademark "DECHLORANE" by Hooker Chemical Company and Santoprene 201-87 is a melt processible olefinic copolymer rubber sold under the "SANTOPRENE" Trademark by the Monsanto Company.

After preparing the compositions of above Table II into molded slabs as previously described, the slabs exhibited the properties shown in following Table III upon exposure to the temperature and radiation levels indicated.

TABLE III

| | Control | | | 8 hrs at 140° C. | | | 8 hrs at 140° C. + 34.2 MR | | |
|---|---|---|---|---|---|---|---|---|---|
| | Tensile Strength (psi) | % Elongation at break | Modulus at 100% Elongation (psi) | Tensile Strength (psi) | % Elongation at break | Modulus at 100% Elongation (psi) | Tensile Strength (psi) | % Elongation at break | Modulus at 100% Elongation (psi) |
| R | 1201 | 435 | 977 | 1455 | 360 | 1184 | 2188 | 253 | 1455 |
| T | 2063 | 460 | 923 | 1922 | 350 | 1024 | 725 | 10 | — |
| U | 2047 | 460 | 1792 | 2267 | 390 | 1977 | 1973 | 10 | — |
| V | 1416 | 497 | 1100 | 1537 | 347 | 1277 | 2510 | 287 | 1366 |

The data shown in above the Table III illustrates the ability of the jacket composition of the heating cable of the invention to resist degradation upon exposure to radiation and elevated temperature conditions characteristically associated with the manufacture of such heating cables.

The composition can be melt extruded as a protective jacket about a semi-conductive cable of the type hereinbefore described in combination with a shape retaining jacket made from an unplasticized material such as a thermoplastic polyurethane polymer or in the alternate directly about the semi-conductive composition to provide a shape retaining jacket that is flame retardant and will suffer minimal color change during the process of crosslinking both the jacket and the semi-conductive composition by high energy radiation as well as minimize changes in ambient electrical resistance characteristically associated with such cables.

By way of example illustrating the ability of above composition "R" to minimize changes in ambient electrical resistance, a comparison was made as illustrated in following Table IV between a one foot piece of a conventional polyolefin based semi-conductive self-regulating heating cable having a polyurethane self-retaining jacket disposed intermediate the semi-conductive composition and a jacket made from composition "R" and an equivalent cable in which the outer jacket was replaced with a jacket made from the various other materials indicated. After recording the initial electrical resistance between the electrical conductors of both cables, both were placed in a 90° C. oven and removed at 100 hours, 300 hours, 500 hours, and at 700 hours and allowed to stabilize at ambient temperature before resistance measurements were taken.

TABLE IV

| Jacket Composition | % change in ambient electrical resistance (ohms) of semi-conductive composition — hours at 90° C. 100 | 300 | 500 | 700 |
|---|---|---|---|---|
| No jacket | −4 | +10 | −4 | −10 |
| Composition "R" | — | −6 | −12 | −18 |
| Chlorinated polyethylene with plasticizer | +95 | +250 | — | — |
| Composition 10× | +190 | +220 | — | — |
| Telcar 3260 | +80 | +296 | +320 | +350 |
| TPR-1900 | +86 | +350 | — | |
| Elexar 8614Z | +112 | — | — | — |

In above Table IV, composition 10X is a Santoprene based composition similar to Formula "T" in Table II. Telcar 3260 is an ethylene-propylene based rubber sold by Teknor Apex under the "TELCAR" Trademark. TPR-1900 is a propylene rubber sold by Uniroyal under the Trademark "TPR" and Elexar 8614Z is an ethylene-butylene styrene block copolymer sold under the "ELEXAR" Trademark by Shell Chemical.

The data shown in above Table IV illustrates that the cable having the jacket made from composition "R" suffered little change in ambient electrical resistance after 700 hours in the oven at 90° C. whereas the cables enclosed by the other materials indicated suffered a marked change in ambient electrical resistance. The data further illustrates the surprising result that only certain EPDM and EPR elastomers may be used to practice the invention and that although one skilled in the art might expect that elastomers such as SANTOPRENE, TELCAR 3260, TPR-1900 and ELEXAR 8614Z would provide similar results, they do not. In view of this fact, the invention broadly contemplates component "A" of the composition as being any thermoplastic elastomer or blends of thermoplastic elastomers which, in combination with components "B" and "C", provide a jacket for use about a semi-conductive composition that is able to minimize changes in ambient electrical resistance of the semi-conductive composition upon exposure to heat and is further able to minimize changes in color of the jacket arising from exposure to radiation and heat up to and including the temperature of annealing the semi-conductive composition as hereinbefore described.

In the case of plasticized materials, it is believed that migration of the plasticizer through the polyurethane shape retaining jacket and into the semi-conductive composition causes an irrevocable increse in the ambient electrical resistance of the cable and rendered it unsuitable for commercial use which is understandably predicated upon maintenance of a substantially constant ambient resistance for regulatory control. It is also clear that the jacket composition of the cable of the invention provides a means of utilizing halogenated flame retardants without the need for plasticizers and their apparent detrimental effect upon the electrical resistance of the cable.

Jackets for use with self-regulating, semi-conductive heating cables of the invention have been found to possess strength and temperature properties suitable to enable the jacket to maintain the shape of the semi-conductive composition at annealing temperatures of higher than 140° C. as well as to resist color change upon exposure to radiation associated with their manufacture in addition to providing a means of imparting flame retardancy to the cable without plasticizers and their adverse effect upon the ambient electrical resistance of the cable.

What is claimed is:

1. An improved, flexible, self-regulating heating cable of the type having at least one pair of spaced-apart elongate electrical conductors electrically interconnected by means of a semi-conductive composition that is enclosed by electrically insulating jacket wherein the improvement is characterized by said jacket being the radiation crosslinked product of a composition comprising a mixture of: (A) from about 50 parts to about 80 parts by weight to the total weight of the composition of at least one elastomer; (B) from about 20 parts to about 50 parts by weight to the total weight of the composition of a polymer selected from the group consisting of polyethylene polymer, polypropylene, polymer, and blend thereof and; (C) an effective amount by weight to the total weight of the composition of a heat stabilizer, said jacket having the ability to minimize changes in the ambient electrical resistance of the semi-conductive composition and having improved resistance to color change arising from exposure of the cable to radiation and elevated temperature up to and including the annealing temperature of the semi-conductive composition.

2. An improved, flexible, self-regulating heating cable of the type having at least one pair of spaced-apart elongate electrical conductors electrically interconnected by means of a semi-conductive composition that is enclosed by electrically insulating jacket wherein the improvement is characterized by said jacket being the radiation crosslinked product of a composition comprising a mixture of: (A) from about 50 parts to about 80 parts by weight to the total weight of the composition of at least one elastomer selected from the group consisting of a terpolymer of ethylene, propylene and at least one diene, ethylene-propylene rubber, and blends thereof; (B) from about 20 parts to about 50 parts by weight to the total weight of the composition of polymer of polyethylene, polyprpylene or blends thereof and; (C) an effective amount by weight to the total weight of the composition of a heat stabilizer, said jacket having the ability to minimize changes in the ambient electrical resistance of the semi-conductive composition and having improved resistance to color change arising from exposure of the cable to radiation and elevated temperature up to and including the annealing temperature of the semi-conductive composition.

3. An improved, flexible, self-regulating heating cable of the type having at least one pair of spaced-apart elongate electrical conductors electrically interconnected by means of a semi-conductive composition that is enclosed by electrically insulating jacket wherein the improvement is characterized by said jacket being the radiation crosslinked product of a composition comprising a mixture of: (A) from about 50 parts to about 80 parts by weight to the total weight of the composition of an elastomer comprising a terpolymer of ethylene, propylene and at least one diene; (B) from about 20 parts to about 50 parts by weight to the total weight of the composition of a polymer of polyethylene, polypropylene or blend thereof and; (C) an effective amount by weight to the total weight of the composition of a heat stabilizer, said jacket having the ability to minimize changes in the ambient electrical resistance of the semi-conductive composition and having improved resistance to color change arising from exposure of the cable to radiation and elevated temperature up to and including the annealing temperature of the semi-conductive composition.

4. The cable of claim 1, 2 or 3 wherein the composition comprises a mixture of: about 60 parts of elastomer (A); about 40 parts of the polyolefin polymer (B) and; about 2 parts of the heat stabilizer (C).

5. The cable of claim 1, 2 or 3 wherein the composition includes up to about 50 parts by weight of a halogenated flame retardant material to the total weight of the composition.

6. The cable of claim 5 wherein the composition includes up to about 20 parts by weight of antimony oxide to the total weight of the composition.

7. The cable of claim 4 wherein the composition includes up to about 35 parts of a halogenated flame retardant material to the total weight of the composition.

8. The cable of claim 7 wherein the composition includes up to about 15 parts by weight of antimony oxide to the total weight of the composition.

9. The cable of claim 1, 2 or 3 wherein the polyolefin polymer (B) is a polypropylene polymer.

10. The cable of claim 4 wherein the polyolefin polymer (B) is a polypropylene polymer.

11. The cable of claim 1, 2 or 3 wherein the heat stabilizer is a tetra-basic lead fumarate heat stabilizer.

12. The cable of claim 4 wherein the heat stabilizer is a tetra-basic lead fumarate heat stabilizer.

13. The cable of claim 5 wherein the halogenated flame retardant material is decabromobiphenyl oxide.

14. The cable of claim 7 wherein the halogenated flame retardant material is decabromobiphenyl oxide.

15. The cable of claim 5 wherein the halogenated flame retardant material is a chlorinated flame retardant material.

16. The cable of claim 7 wherein the halogenated flame retardant material is a chlorinated flame retardant material.

17. The cable of claim 1, 2 or 3 wherein the composition includes an enhancing crosslinking effective amount by weight of a radiation sensitizer to the total weight of the composition.

18. The cable of claim 4 wherein the composition includes an enhancing crosslinking effective amount by weight of a radiation sensitizer to the total weight of the composition.

19. The cable of claim 5 wherein the composition includes an enhancing crosslinking effective amount by weight of a radiation sensitizer to the total weight of the composition.

20. The cable of claim 17 wherein the radiation sensitizer is trimethylolpropane trimethacrylate.

21. The cable of claim 18 wherein the radiation sensitizer is trimethylolpropane trimethacrylate.

22. The cable of claim 19 wherein the radiation sensitizer is trimethylolpropane trimethacrylate.

23. The cable of claim 1, 2 or 3 wherein the composition includes an effective amount by weight of an antioxidant to the total weight of the composition.

24. The cable of claim 4 wherein the composition includes an effective amount by weight of an antioxidant to the total weight of the composition.

25. The cable of claim 5 wherein the composition includes an effective amount by weight of an antioxidant to the total weight of the composition.

26. The cable of claim 23 wherein the antioxidant is a tetrafunctional phenolic antioxidant.

27. The cable of claim 24 wherein the antioxidant is a tetrafunctional phenolic antioxidant.

28. The cable of claim 25 wherein the antioxidant is a tetrafunctional phenolic antioxidant.

29. The cable of claim 1, 2 or 3 wherein the composition includes an effective amount by weight of a colorant to the total weight of the composition.

30. The cable of claim 4 wherein the composition includes an effective amount by weight of a colorant to the total weight of the composition.

31. The cable of claim 5 wherein the composition includes an effective amount by weight of a colorant to the total weight of the composition.

32. The cable of claim 1, 2 or 3 wherein the composition includes up to about 20 parts by weight of a filler to the total weight of the composition.

33. The cable of claim 4 wherein the composition includes up to about 20 parts by weight of a filler to the total weight of the composition.

34. The cable of claim 5 wherein the composition includes up to about 20 parts by weight of a filler to the total weight of the composition.

* * * * *